US006933860B1

(12) United States Patent
Gehman

(10) Patent No.: US 6,933,860 B1
(45) Date of Patent: Aug. 23, 2005

(54) METHOD AND APPARATUS FOR THE DISPLAY OF TEMPORAL DISTANCE DATA

(75) Inventor: Les Gehman, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 26 days.

(21) Appl. No.: 10/836,554

(22) Filed: Apr. 29, 2004

(51) Int. Cl.[7] ..... G08G 1/123

(52) U.S. Cl. ..... 340/995.1; 340/995.11; 340/995.12; 340/995.13; 340/995.14; 340/995.16; 340/995.17; 340/995.18; 340/995.19; 340/995.21; 340/995.23; 340/995.24; 340/995.25; 340/995.27; 340/995.28; 701/204

(58) Field of Search ..... 340/995.1, 995.11, 340/995.12, 995.13, 995.14, 995.15, 995.16, 340/995.17, 995.18, 995.19, 995.2, 995.21, 340/995.22, 995.23, 995.24, 995.25, 995.26, 340/995.27, 995.28; 701/200, 204

(56) References Cited

U.S. PATENT DOCUMENTS 6,785,608 B1 * 8/2004 Milici et al. ..... 701/209
6,826,472 B1 * 11/2004 Kamei et al. ..... 701/202
6,856,901 B2 * 2/2005 Han ..... 701/211

* cited by examiner

*Primary Examiner*—Daryl C Pope
(74) *Attorney, Agent, or Firm*—Leslie P. Gehman

(57) ABSTRACT

An electronic device is built including a memory, a processor, and a display. The processor is configured to calculate an array of estimated travel time data from a first location to a plurality of locations within a destination area from a set of situational parameters and a set of user parameters. These situational parameters may include data such as: the location, condition, and speed limits of roads and paths; the availability of public transportation; terrain information such as elevation, slope, the presence of trails and vegetation; and weather information such as wind speed and precipitation. User parameters may include data such as: the user's mode of transportation, the user's physical abilities, and the load the user is carrying.

65 Claims, 5 Drawing Sheets

METHOD AND APPARATUS FOR THE DISPLAY OF TEMPORAL DISTANCE DATA

FIELD OF THE INVENTION

The present invention relates generally to the field of calculation and graphical display of data and more particularly to the calculation and graphical display of temporal data from distances.

BACKGROUND OF THE INVENTION

When traveling, one generally doesn't care as much about the distance to a destination as much as the time it takes to get there. When planning travels, it is difficult to plan stops in advance since so many parameters affecting speed are unavailable on a standard map or global positioning system (GPS) device. In a wilderness situation, it may be critical to know if a road or help can be reached before sunset. It may be better to spend remaining daylight hours building shelter for the night instead of pushing on to unreachable help. Current maps and GPS devices are very good at calculating distances and showing elevations, but are incapable of translating that information into travel time.

SUMMARY OF THE INVENTION

An electronic device is built including a memory, a processor, and a display. The processor is configured to calculate an array of estimated travel time data from a first location to a plurality of locations within a destination area from a set of situational parameters and a set of user parameters. These situational parameters may include data such as: the location, condition, and speed limits of roads and paths; the availability of public transportation; terrain information such as elevation, slope, the presence of trails and vegetation; and weather information such as wind speed and precipitation. User parameters may include data such as: the user's mode of transportation, the user's physical abilities, and the load the user is carrying.

Other aspects and advantages of the present invention will become apparent from the following detailed description, taken in conjunction with the accompanying drawings, illustrating by way of example the principles of the invention.

DETAILED DESCRIPTION

Figure 1:
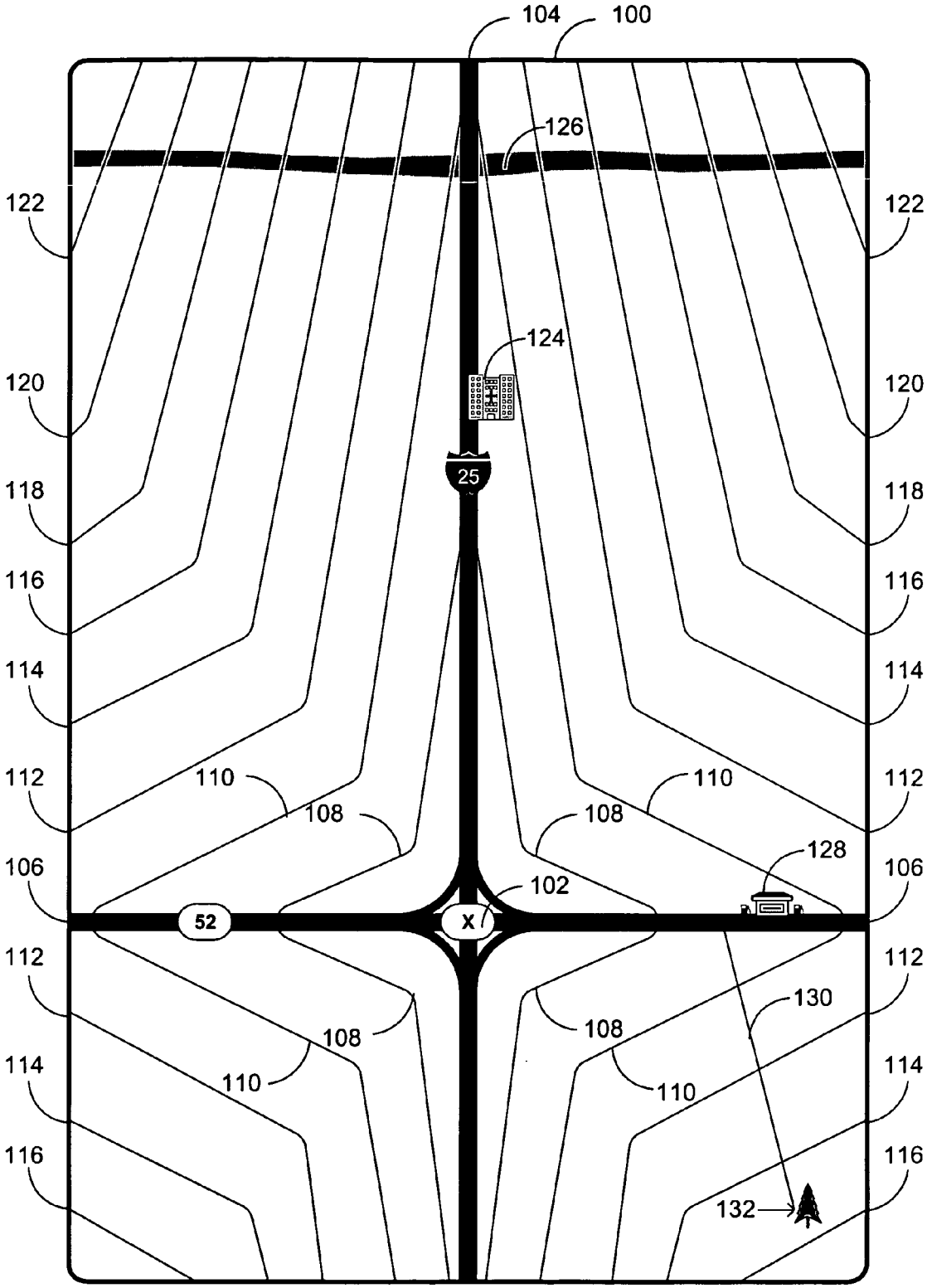
FIG. 1 is an example of a display output of temporal distance data according to the present invention.

FIG. 1 is an example of a display output of temporal distance data according to the present invention. In this example embodiment of the present invention an electronic display 100 is configured to graphically represent temporal distance data within a destination area. The temporal distance data is represented by a set of temporal contour lines 108, 110, 112, 114, 116, 118, 120, and 122 each of which represents a distance the user can travel in a give time. For example, the first contour line 108 may represent all the locations that the user can travel to in five minutes, while the second contour line 110 may represent all the locations that the user can travel to in ten minutes, with the remaining contour lines similarly having a spacing of five minutes. In this example, an interstate highway 104 runs top to bottom on the display screen 100, and a state highway 106 runs left to right on the display screen 100. Note, that the orientation of the screen with respect to the direction North is not shown in this example embodiment, but for the present example we may assume that North is at the top of the display screen 100. A first location 102 is shown by an "X" at the intersection of the interstate highway 104 and the state highway 106. This first location 102 may represent the current location of the user or any other location that is desired. All temporal distance data is calculated from this first location 102. Note that the destination area shown on the screen 100 does not necessarily need to include the first location 102. For a distant destination, it may be desirable to select a smaller destination area not including the first location 102 so that it is possible to have higher resolution temporal distance data for the destination area alone than would be possible with an area large enough to also include the first location 102. For this example embodiment of the present invention, the screen 100 shows the entire destination area, however other embodiments may use the screen 100 to show a portion of the destination area. Also shown on the display screen 100 are a river 126 flowing under the interstate highway 104, a hospital 124 located on the interstate highway 104, a gas station 128 located on the state highway 106, a hiking trail 130 leaving from the state highway 106, and a scenic view 132 at the end of the hiking trail 130.

In this example embodiment of the present invention, temporal distance data is displayed using a series of temporal contour lines 108, 110, 112, 114, 116, 118, 120, and 122 each of which represents a distance the user can travel in a give time. However, those of skill in the art will recognize that temporal distance data may be graphically represented in a wide variety of methods including shading, and coloring within the scope of the present invention. FIG. 1 shows an example embodiment of the present invention using shading to represent temporal distance data. A first contour line 108 is shown on the display screen 100 representing all the locations that the user is capable of traveling to within a first time interval. A second contour line 110 is shown on the display screen 100 representing all the locations that the user is capable of traveling to within a second time interval. A third contour line 112 is shown on the display screen 100 representing all the locations that the user is capable of traveling to within a third time interval. A fourth contour line 114 is shown on the display screen 100 representing all the locations that the user is capable of traveling to within a fourth time interval. A fifth contour line 116 is shown on the display screen 100 representing all the locations that the user is capable of traveling to within a fifth time interval. A sixth contour line 118 is shown on the display screen 100 representing all the locations that the user is capable of traveling to within a sixth time interval. A seventh contour line 120 is shown on the display screen 100 representing all the locations that the user is capable of traveling to within a seventh time interval. Finally, an eighth contour line 122 is shown on the display screen 100 representing all the locations that the user is capable of traveling to within an eighth time interval. These contour lines form a graphical representation of temporal distance data similar to the contour lines on a topographic map, except that the contour lines in the present invention represent time intervals instead of elevations as on a topographic map.

While this example embodiment of the present invention demonstrates a graphical representation of temporal distance data for travel over land, other embodiments may be used for travel by air or sea. For example, the situational parameters used for travel by air may include wind speed and direction at a variety of altitudes, and for travel by sea the parameters may include such data as water depth, currents, and swell heights.

Figure 2:
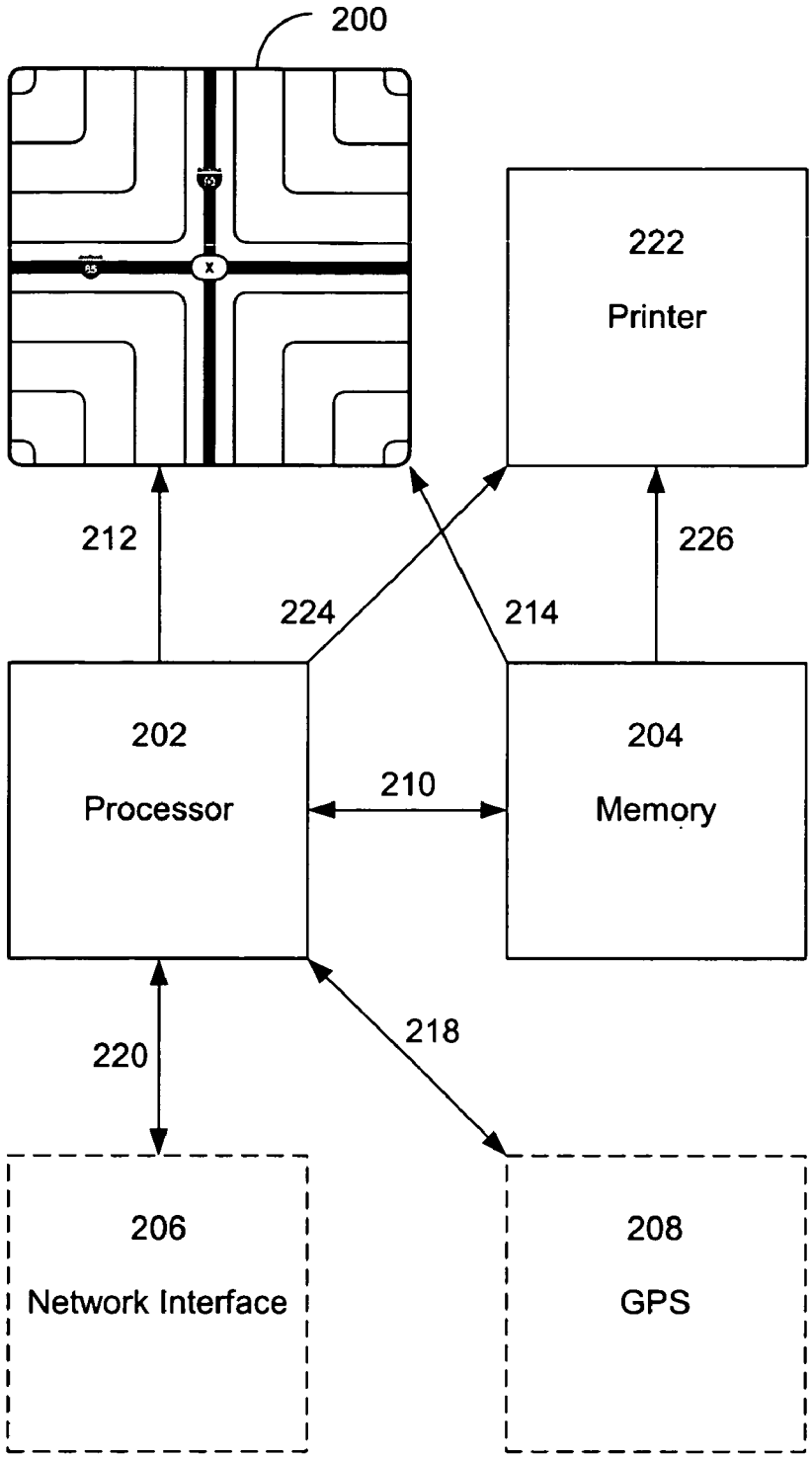
FIG. 2 is a block diagram of an electronic device designed for the calculation and display of temporal distance data according to the present invention.

FIG. 2 is a block diagram of an electronic device designed for the calculation and display of temporal distance data according to the present invention. In this example embodiment of the present invention an electronic device includes a display screen 200 similar to that shown in FIG. 1 is electrically connected to a processor 202 and a memory 204 through electrical buses 212 and 214 respectively. In a memory mapped system the graphical data for display on the screen 200 will be stored in the memory 204 and displayed on the screen using common techniques known by those of skill in the art, while the processor 202 may control when the display 200 is updated from the memory 204. Those of skill in the art will recognize that this is a very simplistic block diagram representing any of the common methods for the display of graphics data on a screen 200. Optionally, a GPS device 208 may included within the electronic device to provide to the processor 218 such information as the current location, elevation, speed of travel, and direction of travel through an electronic bus 218. The current location may be selected by the user to be used as the first location for the calculation of temporal distance data. The elevation, speed of travel, and direction of travel may represent situational parameters for use in the calculation of temporal distance data. Also optionally, a network connection 206 may be included within the electronic device providing access to situational or user parameters stored externally from the electronic device. This data is sent to the processor through an electrical connection 220, and the processor may control the network interface 206 through this same connection 220.

The processor 202 uses the first location, destination area, user parameters, and situational parameters to calculate temporal distance data for a region surrounding the first location. The user parameters may include data such as: the user's mode of transportation, the user's driving habits, the user's physical condition, the load the user is carrying, and any other attributes relating to the user. The situational parameters may include data such as: the location and condition of roads, highways, and trails, the location of emergency services (such as hospitals 124, police stations, and gas stations 128), terrain information (such as elevation, slope, trails 130, and vegetation), weather information (such as temperature, precipitation, wind speed, etc.), transportation information (such as the location of bus stops, rail lines, subways, etc.), along with any of a wide variety of information that impacts the ability of the user to travel. The destination area will typically be selected by the user, however in some embodiments of the present invention, the destination area may be predetermined or input through a network interface 206. The processor 202 may use a very wide variety of algorithms to convert this first location, user parameters, and situational parameters into temporal distance data within the scope of the present invention. Those of skill in the art will recognize that given a road with a speed limit it is easy to calculate the time required to drive any given length of the road assuming a rate of travel at the speed limit. User parameters and situational parameters are used to modify this rate of travel which is then used to calculate the temporal distance data.

The temporal distance data calculated by the processor 202 is then stored in a memory 204 for display or printing. A printer 222 may be connected to the processor 202 and memory 204 for use in graphically representing temporal distance data in addition to, or instead of, the display 200.

Figure 3:
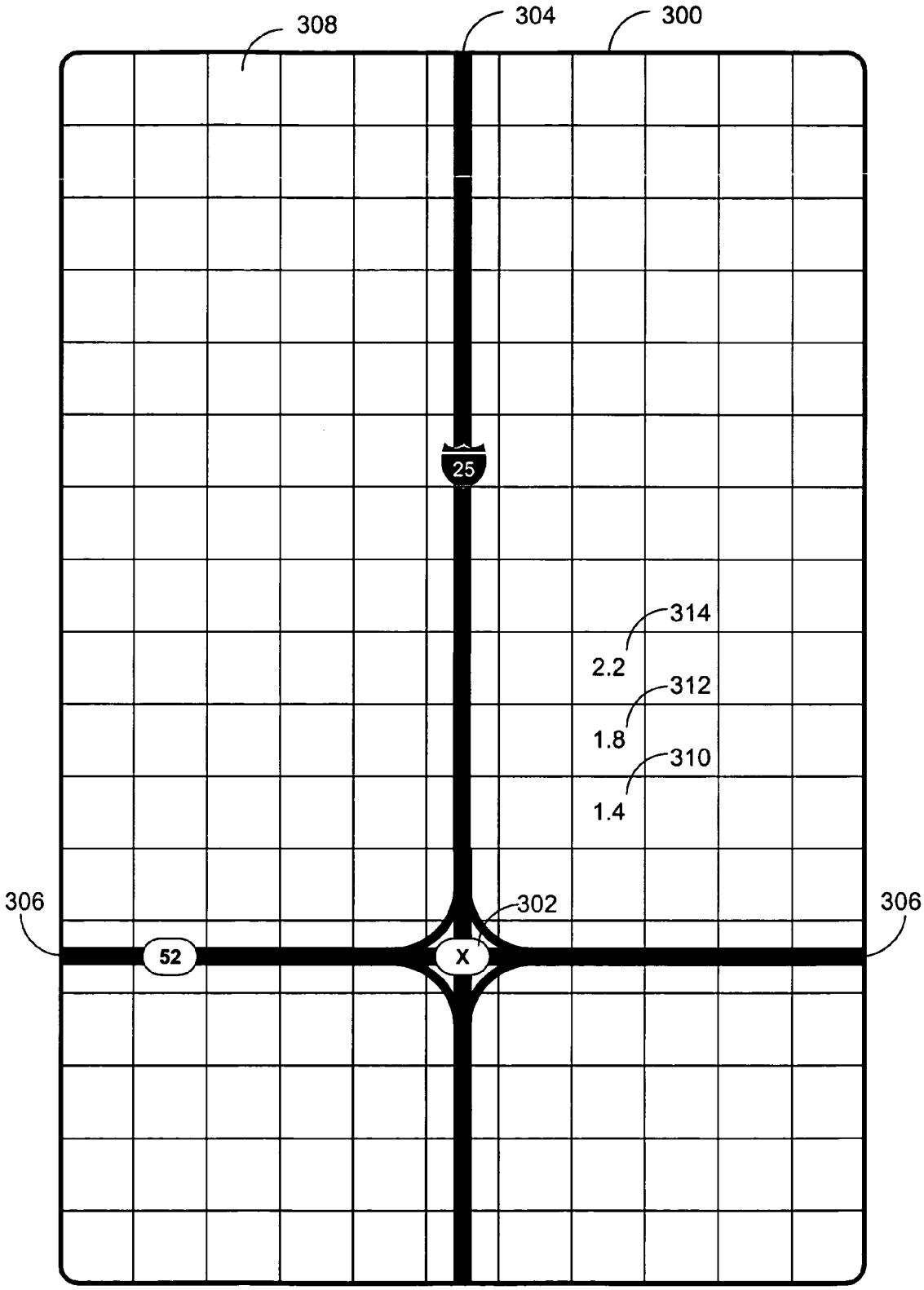
FIG. 3 is an example of a display divided into an array of regions for the calculation and representation of temporal distance data according to the present invention.

FIG. 3 is an example of a display divided into an array of regions for the calculation and representation of temporal distance data according to the present invention. In this example embodiment of the present invention, the display 300 is divided into a regular array of regions 308 which may represent individual pixels on the display 300. Similar to FIG. 1, the display 300 includes an interstate highway 304 and a state highway 306. The first location 302 is represented by an "X." For each of these regions 308 the time required for the user to travel from the first location 302 to the region 308 is calculated. In this example embodiment of the present invention, the travel time to region 310 is calculated as 1.4 minutes, the travel time to region 312 is calculated as 1.8 minutes, and the travel time to region 314 is calculated as 2.2 minutes. These calculations are then repeated for some or all of the remaining regions 308. Once travel time to each region 308 is calculated, the resulting temporal distance data is graphically represented on the display 300. Those of skill in the art will recognize that there is a wide variety of methods available for the graphical representation of data on a display 300. The examples shown in this disclosure are simply representative methods of the graphical representation of temporal distance data, and the present invention is not limited to these examples.

Figure 4:
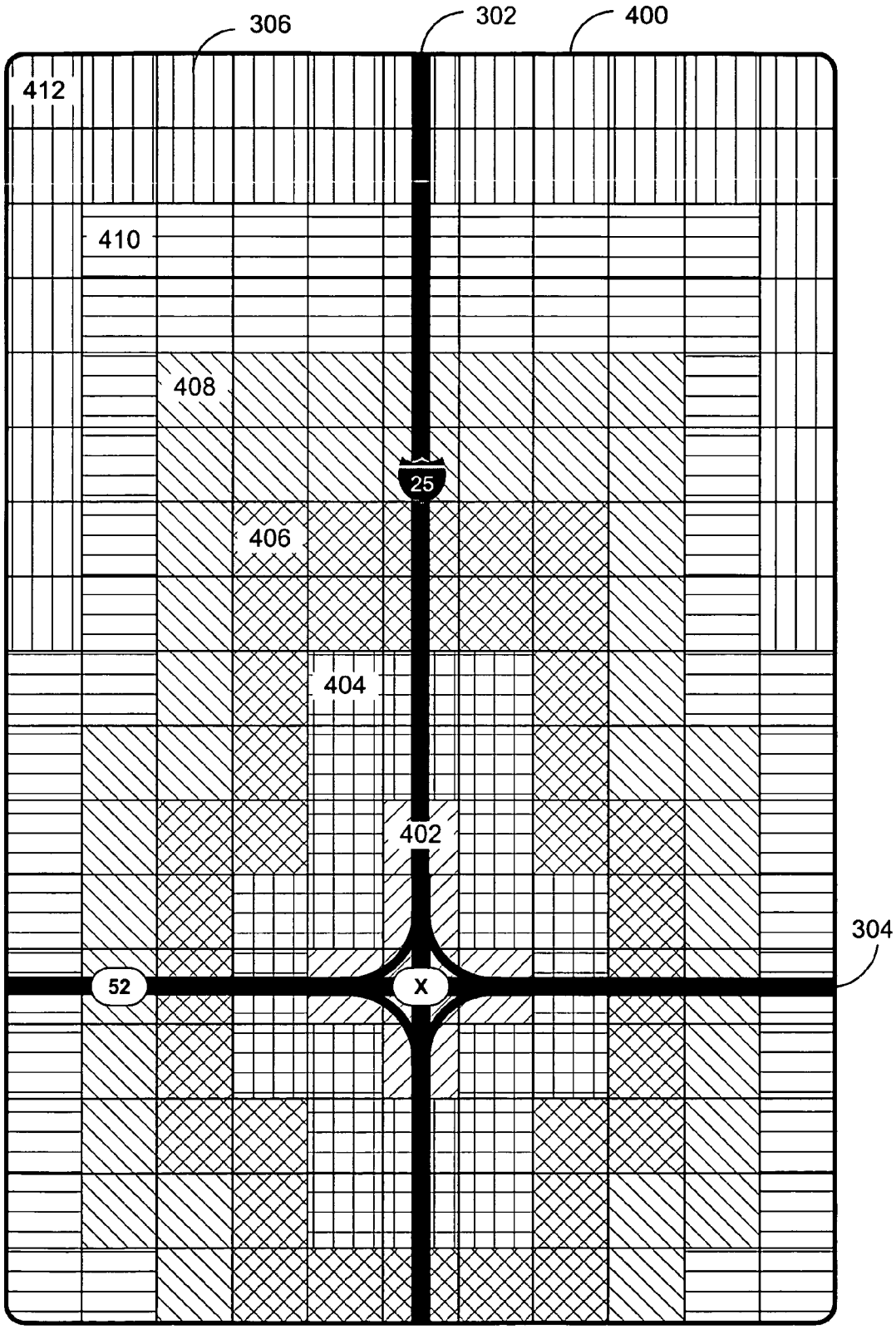
FIG. 4 is an example of a display output of temporal distance data according to the present invention.

FIG. 4 is an example of a display output of temporal distance data according to the present invention. In this example embodiment of the present invention, a series of time intervals has been selected, and the temporal distance data has been binned according to those intervals. For example, the first time interval may be from zero to five minutes, while the second time interval may be from five to ten minutes, and so forth. Each region 306 has a travel time associated with it and thus falls into one of the plurality of time intervals. In this example, regions 306 with temporal distance data falling within the first time interval are represented by a first shade 402. Regions 306 with temporal distance data falling within the second time interval are represented by a second shade 404. Regions 306 with temporal distance data falling within the third time interval are represented by a third shade 406. Regions 306 with temporal distance data falling within the fourth time interval are represented by a fourth shade 408. Regions 306 with temporal distance data falling within the fifth time interval are represented by a fifth shade 410. Finally, regions 306 with temporal distance data falling within the sixth time interval are represented by a sixth shade 412. In other examples of the present invention colors may be used in place of shading, or contour lines may be drawn through the regions similar to those shown in FIG. 1.

Figure 5:
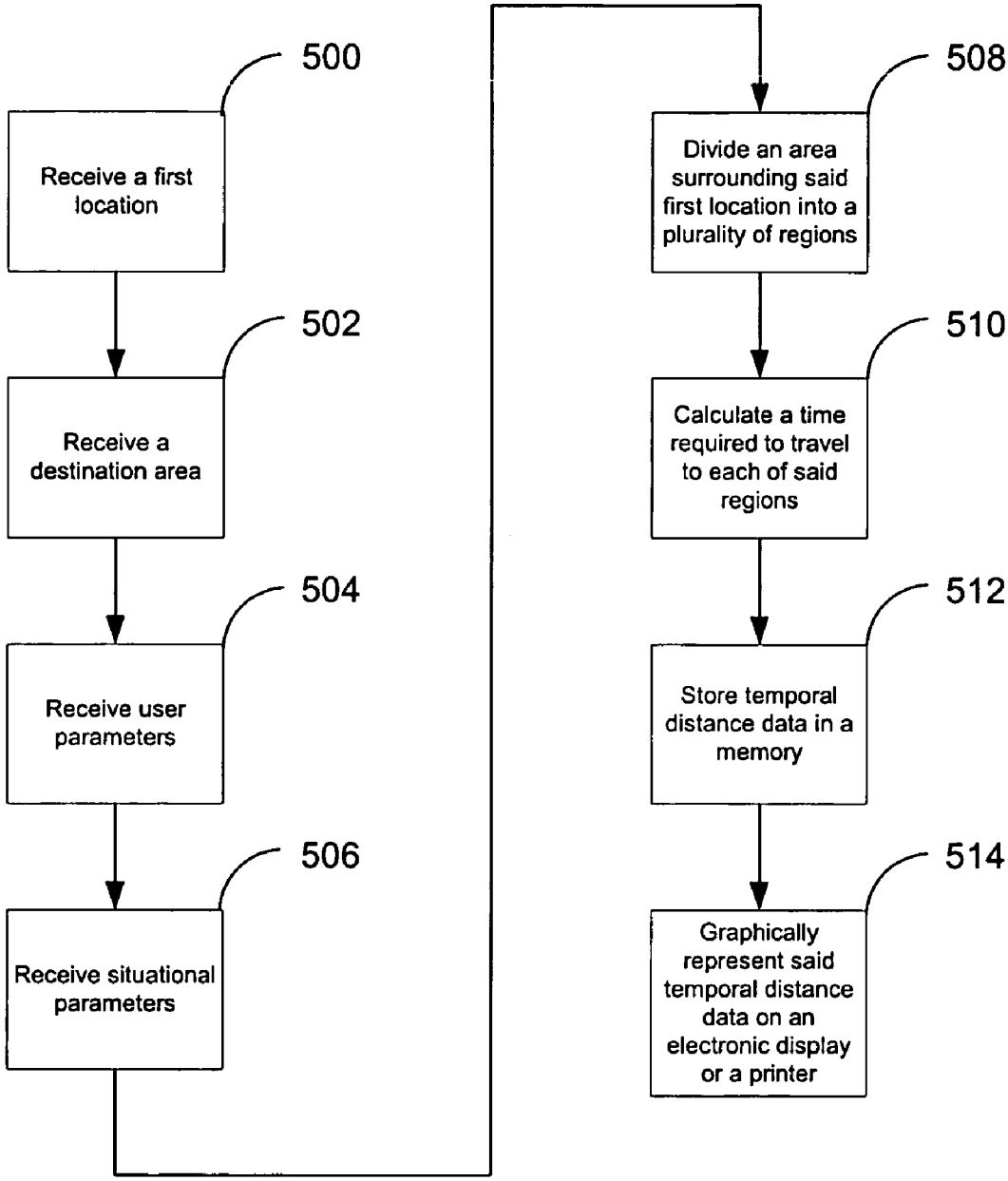
FIG. 5 is a flow chart of a method for the calculation and display of temporal distance data according to the present invention.

FIG. 5 is a flow chart of a method for the calculation and display of temporal distance data according to the present invention. In a step 500, a first location is received. This first location may be input by the user or come from another source such as a database of locations, or an optional GPS device. In a step 502, a destination area is received. In a step 504, user parameters are received. User parameters may come directly from the user, from a local database in memory, or possibly from an external database accessed through an optional network connection. In a step 506, situational parameters are received. Situational parameters may come from a local database in memory, or possibly from an external database or other computer accessed through an optional network connection. In a step 508, an area surrounding the first location is divided into a plurality of regions. These regions may be any shape desired within the scope of the present invention. In a step 510, a time required to travel to at lease some of the regions is calculated. Note, that there is no need to calculate travel time to regions that are not going to be displayed, and other embodiments may compute travel time for a subset of the regions as desired within the scope of the present invention. In a step 512, the temporal distance data calculated in step 510 is stored in a memory. In a step 514, the temporal distance data is graphically represented on an electronic display or a printer.

The foregoing description of the present invention has been presented for purposes of illustration and description. It is not intended to be exhaustive or to limit the invention to the precise form disclosed, and other modifications and variations may be possible in light of the above teachings. The embodiments were chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An electronic device comprising:

a memory configured to store a first location, destination area, user parameters, and situational parameters;

a processor electrically coupled to said memory, and configured to calculate temporal distance data for a destination area from said first location, user parameters, and situational parameters, and store said temporal distance data in said memory; and a display electrically coupled to said memory, and configured to graphically represent said temporal distance data.

2. An electronic device as recited in claim 1, further comprising:

a GPS device electrically coupled to said processor configured to provide said first location.

3. An electronic device as recited in claim 1, further comprising:

a network interface electrically coupled to said processor configured to receive at least some of said situational parameters from an external computer.

4. An electronic device as recited in claim 1, wherein said user parameters include a mode of transportation.

5. An electronic device as recited in claim 1, wherein said user parameters include a user's physical condition.

6. An electronic device as recited in claim 1, wherein said user parameters include a load the user is carrying.

7. An electronic device as recited in claim 1, wherein said situational parameters include the location of roads.

8. An electronic device as recited in claim 7, wherein said situational parameters include the condition of said roads.

9. An electronic device as recited in claim 7, wherein said situational parameters include the speed limit of said roads.

10. An electronic device as recited in claim 1, wherein said situational parameters include the current weather conditions.

11. An electronic device as recited in claim 1, wherein said situational parameters include a weather forecast.

12. An electronic device as recited in claim 1, wherein said situational parameters includes terrain data.

13. An electronic device as recited in claim 1, wherein said situational parameters includes elevation data.

14. An electronic device as recited in claim 1, wherein said situational parameters include the location of trails.

15. An electronic device as recited in claim 1, wherein said situational parameters include the location and type of emergency services.

16. An electronic device as recited in claim 1, wherein said situational parameters include the location of gas stations.

17. An electronic device as recited in claim 1, wherein said situational parameters include the location of hotels.

18. An electronic device as recited in claim 1, wherein said temporal distance data includes all locations reachable within a time limit.

19. An electronic device as recited in claim 1, wherein said graphical representation includes temporal contour lines.

20. An electronic device as recited in claim 1, wherein said graphical representation includes shaded areas.

21. An electronic device as recited in claim 1, wherein said graphical representation includes colored areas.

22. An electronic device comprising:

a memory configured to store a first location, destination area, user parameters, and situational parameters;

a processor electrically coupled to said memory, and configured to calculate temporal distance data for a destination area from said first location, user parameters, and situational parameters, and store said temporal distance data in said memory; and a printer electrically coupled to said memory, and configured to graphically represent said temporal distance data.

23. An electronic device as recited in claim 22, further comprising:

a GPS device electrically coupled to said processor configured to provide said first location.

24. An electronic device as recited in claim 22, further comprising:

a network interface electrically coupled to said processor configured to receive at least some of said situational parameters from an external computer.

25. An electronic device as recited in claim 22, wherein said user parameters include a mode of transportation.

26. An electronic device as recited in claim 22, wherein said user parameters include a user's physical condition.

27. An electronic device as recited in claim 22, wherein said user parameters include a load the user is carrying.

28. An electronic device as recited in claim 22,
wherein said situational parameters include the location of roads.

29. An electronic device as recited in claim 28,
wherein said situational parameters include the condition of said roads.

30. An electronic device as recited in claim 28,
wherein said situational parameters include the speed limit of said roads.

31. An electronic device as recited in claim 22,
wherein said situational parameters include the current weather conditions.

32. An electronic device as recited in claim 22,
wherein said situational parameters include a weather forecast.

33. An electronic device as recited in claim 22,
wherein said situational parameters includes terrain data.

34. An electronic device as recited in claim 22,
wherein said situational parameters includes elevation data.

35. An electronic device as recited in claim 22,
wherein said situational parameters include the location of trails.

36. An electronic device as recited in claim 22,
wherein said situational parameters include the location and type of emergency services.

37. An electronic device as recited in claim 22,
wherein said situational parameters include the location of gas stations.

38. An electronic device as recited in claim 22,
wherein said situational parameters include the location of hotels.

39. An electronic device as recited in claim 22,
wherein said temporal distance data includes all locations reachable within a time limit.

40. An electronic device as recited in claim 22,
wherein said graphical representation includes temporal contour lines.

41. An electronic device as recited in claim 22,
wherein said graphical representation includes shaded areas.

42. An electronic device as recited in claim 22,
wherein said graphical representation includes colored areas.

43. A method for the graphical display of temporal distance data comprising the steps of:

a) receiving a first location;

b) receiving a destination area;

c) receiving user parameters;

d) receiving situational parameters;

e) dividing said destination area into a plurality of regions;

f) calculating an estimated time required to travel from said first location to at least some of said plurality of regions; and g) saving temporal distance data resulting from said calculating step in a memory; and h) graphically representing said temporal distance data.

44. A method for the graphical display of temporal distance data as recited in claim 43,
wherein said step of graphically representing said temporal distance data uses an electronic display.

45. A method for the graphical display of temporal distance data as recited in claim 43,
wherein said step of graphically representing said temporal distance data uses a printer.

46. A method for the graphical display of temporal distance data as recited in claim 43,
wherein said first location is received from a GPS device.

47. A method for the graphical display of temporal distance data as recited in claim 43,
wherein at least some of said situational parameters are received through a network interface.

48. A method for the graphical display of temporal distance data as recited in claim 43,
wherein said user parameters include a mode of transportation.

49. A method for the graphical display of temporal distance data as recited in claim 43,
wherein said user parameters include a user's physical condition.

50. A method for the graphical display of temporal distance data as recited in claim 43,
wherein said user parameters include a load the user is carrying.

51. A method for the graphical display of temporal distance data as recited in claim 43,
wherein said situational parameters include the location of roads.

52. A method for the graphical display of temporal distance data as recited in claim 51,
wherein said situational parameters include the condition of said roads.

53. A method for the graphical display of temporal distance data as recited in claim 51,
wherein said situational parameters include the speed limit of said roads.

54. A method for the graphical display of temporal distance data as recited in claim 43,
wherein said situational parameters include the current weather conditions.

55. A method for the graphical display of temporal distance data as recited in claim 43,
wherein said situational parameters include a weather forecast.

56. A method for the graphical display of temporal distance data as recited in claim 43,
wherein said situational parameters includes terrain data.

57. A method for the graphical display of temporal distance data as recited in claim 43,
wherein said situational parameters includes elevation data.

58. A method for the graphical display of temporal distance data as recited in claim 43,
wherein said situational parameters include the location of trails.

59. A method for the graphical display of temporal distance data as recited in claim 43,
wherein said situational parameters include the location and type of emergency services.

60. A method for the graphical display of temporal distance data as recited in claim 43,
wherein said situational parameters include the location of gas stations.

61. A method for the graphical display of temporal distance data as recited in claim 43,
wherein said situational parameters include the location of hotels.

62. A method for the graphical display of temporal distance data as recited in claim 43, wherein said temporal distance data includes all locations reachable within a time limit.

63. A method for the graphical display of temporal distance data as recited in claim 43, wherein said graphical representation includes temporal contour lines.

64. A method for the graphical display of temporal distance data as recited in claim 43, wherein said graphical representation includes shaded areas.

65. A method for the graphical display of temporal distance data as recited in claim 43, wherein said graphical representation includes colored areas.

* * * * *